US011155767B2

(12) United States Patent
Sato

(10) Patent No.: US 11,155,767 B2
(45) **Date of Patent: *Oct. 26, 2021**

(54) VACUUM PUMP OIL

(71) Applicant: IDEMITSU KOSAN CO., LTD., Chiyoda-ku (JP)

(72) Inventor: Tokue Sato, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/322,015

(22) PCT Filed: Aug. 28, 2017

(86) PCT No.: PCT/JP2017/030799
§ 371 (c)(1),
(2) Date: Jan. 30, 2019

(87) PCT Pub. No.: WO2018/043432
PCT Pub. Date: Mar. 8, 2018

(65) Prior Publication Data

US 2019/0185781 A1 Jun. 20, 2019

(30) Foreign Application Priority Data

Aug. 31, 2016 (JP) ..... JP2016-169461
Aug. 31, 2016 (JP) ..... JP2016-169478

(51) Int. Cl.

| | |
|---|---|
| ***C10M 169/04*** | (2006.01) |
| ***C10M 101/02*** | (2006.01) |
| ***C10M 133/12*** | (2006.01) |
| ***C10M 129/10*** | (2006.01) |
| ***C10M 129/70*** | (2006.01) |
| ***C10M 141/06*** | (2006.01) |
| *C10N 20/02* | (2006.01) |
| *C10N 30/02* | (2006.01) |
| *C10N 30/00* | (2006.01) |
| *C10N 40/30* | (2006.01) |

(52) U.S. Cl.
CPC ..... *C10M 169/04* (2013.01); *C10M 101/02* (2013.01); *C10M 129/10* (2013.01); *C10M 129/70* (2013.01); *C10M 133/12* (2013.01); *C10M 141/06* (2013.01); *C10M 2203/1025* (2013.01); *C10M 2207/284* (2013.01); *C10M 2215/26* (2013.01); *C10N 2020/02* (2013.01); *C10N 2030/02* (2013.01); *C10N 2030/40* (2020.05); *C10N 2040/30* (2013.01)

(58) Field of Classification Search
CPC ..... C10M 2207/284; C10M 2215/26; C10M 2203/1025; C10N 2240/30; C10N 2230/02; C10N 2220/022; C10N 2230/40; C10N 2020/02; C10N 2060/01; C10N 2060/09
See application file for complete search history.

(56) References Cited

U.S. PATENT DOCUMENTS

| | | | | |
|---|---|---|---|---|
| 6,066,604 | A | 5/2000 | Kaneko | |
| 2007/0000807 | A1* | 1/2007 | Wu | C10M 107/02 208/18 |
| 2008/0146469 | A1 | 6/2008 | Sato et al. | |
| 2011/0049008 | A1 | 3/2011 | Tagawa et al. | |
| 2011/0230685 | A1* | 9/2011 | Tagawa | C10G 45/58 585/1 |
| 2012/0040874 | A1 | 2/2012 | Toda | |

FOREIGN PATENT DOCUMENTS

| | | | |
|---|---|---|---|
| CN | 101978035 | A | 2/2011 |
| CN | 102365354 | A | 2/2012 |
| JP | 7-166184 | A | 6/1995 |
| JP | 11-131081 | A | 5/1999 |
| JP | 2006-342149 | A | 12/2006 |
| JP | 2010-163611 | A1 | 7/2010 |
| JP | 2014-129461 | A | 7/2014 |
| JP | 2014-214258 | A | 11/2014 |
| WO | 2010/041591 | A1 | 4/2010 |
| WO | 2010/069986 | A1 | 6/2010 |
| WO | 2014/102153 | A1 | 7/2014 |
| WO | 2014/174106 | A1 | 10/2014 |

OTHER PUBLICATIONS

International Search Report dated Sep. 26, 2017 in PCT/JP2017/030799 filed Aug. 28, 2017.
Extended European Search Report dated Mar. 13, 2020 in European Patent Application No. 17846437.6, 7 pages.
(Continued)

*Primary Examiner* — Vishal V Vasisth
(74) *Attorney, Agent, or Firm* — Oblon, McClelland, Maier & Neustadt, L.L.P.

(57) ABSTRACT

Provided is a vacuum pump oil which contains a mineral oil (A) having a temperature gradient $\Delta|\eta^*|$ of complex viscosity between two points of t(° C.) and t−10(° C.) (where $-15 \leq t \leq -10$), as measured using a rotary rheometer at an angular velocity of 6.3 rad/s, of 10 Pa·s/° C. or less, and one or more compounds selected from a phenol-based compound (B) and an amine-based compound (C), and which has a viscosity index of less than 160. The vacuum pump oil has a good ultimate vacuum degree and is excellent in water separability, oxidation stability and shear stability, and is therefore applicable to various applications.

15 Claims, No Drawings

(56) References Cited

OTHER PUBLICATIONS

Japanese Office Action dated Apr. 7, 2020, in Patent Application No. 2016-169461, 10 pages (with unedited computer generated English translation).
Japanese Office Action dated Apr. 7, 2020, in Patent Application No. 2016-169478, 10 pages (with unedited computer generated English translation).
Notice of Reasons for Refusal dated Nov. 10, 2020 in Japanese Patent Application No. 2016-169461 filed Aug. 31, 2016 (w/ English translation), 8 pages.
Notice of Reasons for Refusal dated Nov. 10, 2020 in Japanese Patent Application No. 2016-169478 filed Aug. 31, 2016 (w/ English translation), 8 pages.
Office Action dated Jun. 8, 2021, in Chinese Patent Application No. 201780047210.8 filed Aug. 28, 2017.
Office Action issued in KR Application No. 10-2019-7002868, dated Sep. 15, 2021, with computer generated translation.

* cited by examiner

VACUUM PUMP OIL

This application is a 371 of PCT/JP2017/030799, filed Aug. 28, 2017.

TECHNICAL FIELD

The present invention relates to a vacuum pump oil.

BACKGROUND ART

Vacuum technology is widely utilized not only in the field of semiconductors, solar cells, airplanes, automobiles and others but also in vacuum packaging or retort pouch processing in a manufacturing process of food.

As vacuum pumps for use in carrying out the vacuum technology corresponding to these technical fields, for example, mechanical vacuum pumps such as reciprocating vacuum pumps and rotary vacuum pumps, and high-vacuum pumps such as oil-sealed rotary vacuum pumps and oil diffusion vacuum pumps are selected depending on the intended use thereof.

With the recent tendency toward broadening the field of application of vacuum pumps, the vacuum pump oil to be used in vacuum pumps is required not only to satisfy an ultimate vacuum degree but also to have improved characteristics of thermal stability and oxidation stability depending on the intended use thereof.

For example, PTL 1 discloses a vacuum pump oil of VG68 Standard which contains, as blended in a base oil produced according to a gas-to-liquid process and so controlled that the content of hydrocarbon having 30 or less carbon atoms therein is not more than a predetermined level, a phenol-based antioxidant and a tackifier of an olefin copolymer or a poly-α-olefin having a molecular weight falling within a predetermined range, and which has a viscosity index of 150 or more.

PTL 2 discloses a vacuum pump oil of VG46 Standard which contains as blended in a base oil produced according to a gas-to-liquid process, a phenol-based antioxidant and is so controlled that, both in a fresh oil state and in a degraded composition state, both the distillation at 380° C. or lower and the distillation at 422° C. or lower are not more than a predetermined level.

PTLs 1 and 2 say that the vacuum pump oils disclosed therein have good thermal stability and are excellent in the ultimate vacuum degree, have a high flash point, have good low-temperature start-up performance and are excellent in high-temperature sealing performance.

CITATION LIST

Patent Literature

PTL 1: JP 2014-129461 A
PTL 2: JP 2014-214258 A

SUMMARY OF INVENTION

Technical Problem

Vacuum pump oils for food processing that are used in vacuum packaging or retort pouch processing are often mixed with water since food itself may contain water and water may be used in the processing step. In the case where water is mixed in the vacuum pump oil used in the vacuum pump and when the vacuum pump oil is excellent in separability from water, the oil may be readily separated into an aqueous layer and an oily layer, and the aqueous layer may be removed in the case.

However, in the case, when the vacuum pump oil is poor in separability from water, the oil may readily emulsify with water mixed therein and water separation therefrom is difficult and, as a result, there occur various problems of vacuum degree reduction and vacuum pump operation failures.

For example, the vacuum pump oils described in PTLs 1 and 2 may often emulsify through water penetration thereinto owing to the presence of additives such as an antioxidant therein, therefore often causing a problem of water separability degradation.

In addition, the vacuum pump oil described in PTL 1 contains, as added thereto, a viscosity index improver for controlling the viscosity of the entire composition and therefore has a problem in that the oil is poor in shear stability.

On the other hand, a vacuum pump oil not containing additives has good water separability and is therefore suitable for use for vacuum pumps for food processing, but is poor in oxidation stability and thermal stability.

Accordingly, such a vacuum pump oil not containing additives is unsuitable for use that requires oxidation stability and thermal stability.

In addition, when such a vacuum pump oil not containing additives is used, for example, in a vacuum pump set in an evaporation system, and when a chemical substance such as an evaporation material is kept mixed in the vacuum pump oil, the chemical substance may polymerize to form a polymer. The presence of the polymer often triggers various problems of ultimate vacuum degree reduction, shear stability reduction and vacuum pump operation failures.

Vacuum pumps are used in various industrial fields, and it is important to suitably determine the applicability thereof and to use vacuum pumps suitable to the determined use.

For example, vacuum pumps for food processing require a vacuum pump oil excellent in oil separability. Vacuum pumps to be set in an evaporation system require a vacuum pump oil excellent in oxidation stability and having a high ultimate vacuum degree.

However, in the case where selection and management of a vacuum pump oil suitable to use thereof is insufficient, such may cause vacuum pump operation failures therefore maybe bringing about serious troubles to go directly to production line stop Consequently, a vacuum pump oil favorably applicable to various applications not requiring change of compounding formulation in each application is desired.

The present invention has been made in consideration of the above-mentioned matters, and its object is to provide a vacuum pump oil having a good ultimate vacuum degree, excellent in water separability, oxidation stability and shear stability, and applicable to various applications.

Solution to Problem

The present inventors have found that the above-mentioned problems can be solved by a vacuum pump oil which contains a mineral oil as so prepared that the temperature gradient $\Delta|\eta^*|$ of complex viscosity between two points of t(° C.) and t−10(° C.) (where $-15 \leq t \leq -10$) could be a predetermined value or less, and at least one or more compounds selected from a phenol-based compound and an amine-based compound, and which has a viscosity index of less than 160.

Specifically, the present invention provides the following [1].

[1] A vacuum pump oil, containing:

a mineral oil (A) having a temperature gradient $\Delta|\eta^*|$ of complex viscosity between two points of t(° C.) and t−10(° C.) (where $-15 \leq t \leq -10$), as measured using a rotary rheometer at an angular velocity of 6.3 rad/s, of 10 Pa·s/° C. or less, and one or more compounds selected from a phenol-based compound (B) and an amine-based compound (C); and having a viscosity index of less than 160.

Advantageous Effects of Invention

The vacuum pump oil of the present invention has a good ultimate vacuum degree and is excellent in water separability, oxidation stability and shear stability. Accordingly, the vacuum pump oil of the present invention can improve such characteristics in a well-balanced manner, and is applicable to various applications.

DESCRIPTION OF EMBODIMENTS

In this description, the kinematic viscosity and the viscosity index are values measured in conformity with JIS K2283.

[Vacuum Pump Oil]

The vacuum pump oil of the present invention contains a mineral oil (A) having a temperature gradient $\Delta|\eta^*|$ of complex viscosity between two points of t(° C.) and t−10(° C.) (where $-15 \leq t \leq -10$), as measured using a rotary rheometer at an angular velocity of 6.3 rad/s, of 10 Pa·s/° C. or less, and one or more compounds selected from a phenol-based compound (B) and an amine-based compound (C), and has a viscosity index of less than 160.

As the vacuum pump oil of one embodiment of the present invention, a vacuum pump oil (1) of the following [1] and a vacuum pump oil (2) of the following [2] are preferred.

The vacuum pump oil (1) is preferably one conformable to VG68 Standard of the viscosity grade defined in ISO 3448, and the vacuum pump oil (2) is preferably one conformable to VG46 thereof.

[1] A vacuum pump oil (1) containing a mineral oil (A) that has a temperature gradient $\Delta|\eta^*|$ of complex viscosity between two points of −10° C. and −20° C., as measured using a rotary rheometer at an angular velocity of 6.3 rad/s, of 5 Pa·s/° C. or less, and one or more compounds selected from a phenol-based compound (B) and an amine-based compound (C), and having a viscosity index of less than 150.

[2] A vacuum pump oil (2) containing a mineral oil (A) that has a temperature gradient $\Delta|\eta^*|$ of complex viscosity between two points of −15° C. and −25° C., as measured using a rotary rheometer at an angular velocity of 6.3 rad/s, of 10 Pa·s/° C. or less, and one or more compounds selected from a phenol-based compound (B) and an amine-based compound (C), and having a viscosity index of less than 160.

In the following of this description, the requirements relating to the vacuum pump oil of the present invention are, unless otherwise specifically indicated, those applicable also to the vacuum pump oils (1) and (2).

As described above, the vacuum pump oil of the present invention has a viscosity index of less than 160, while the viscosity index of the vacuum pump oil (1) is less than 150 and the viscosity index of the vacuum pump oil (2) is less than 160.

In general, for making a vacuum pump oil having a high viscosity index, a large amount of a viscosity index improver is blended therein.

However, a vacuum pump oil containing such a large amount of a viscosity index improver may be excellent in viscosity characteristics at low temperatures and high temperatures, but is problematic in shear stability. Namely, in long-term use, the polymer component constituting the viscosity index improver is shorn to degrade the performance of the vacuum pump oil and to thereby cause vacuum pump oil operation failures.

On the other hand, the vacuum pump oil of the present invention has a viscosity index of less than 160 (the vacuum pump oil (1) has less than 150), that is, the content of the polymer component to be added to the oil as a viscosity index improver is limited.

In addition, in the present invention, by controlling the mineral oil (A), the vacuum pump oil is preferably one conformable to VG68 Standard or VG46 Standard, and by preparing the mineral oil (A) not containing a polymer component (viscosity index improver) having a number average molecular weight (Mn) of 2000 or more, the vacuum pump oil is more preferably one conformable to VG68 Standard or VG46 Standard.

Consequently, the vacuum pump oil of the present invention is excellent in shear stability and even in long-term use, can maintain the excellent performance and can prevent vacuum pump operation failures.

From the above-mentioned viewpoints, the viscosity index of the vacuum pump oil of one embodiment of the present invention is preferably 155 or less, more preferably 150 or less, even more preferably 145 or less.

On the other hand, also from the above-mentioned viewpoints, the viscosity index of the vacuum pump oil (1) of one embodiment of the present invention is preferably 145 or less, more preferably 140 or less, even more preferably 135 or less.

The viscosity index of the vacuum pump oil (2) of one embodiment of the present invention is preferably 155 or less, more preferably 150 or less, even more preferably 145 or less.

From the viewpoint of bettering the viscosity characteristics at high temperatures and low temperatures thereof, the viscosity index of the vacuum pump oils (vacuum pump oils (1) and (2)) of one embodiment of the present invention is preferably 80 or more, more preferably 90 or more, even more preferably 100 or more, and further more preferably 110 or more.

From the viewpoint of providing vacuum pump oils excellent in shear stability by controlling the viscosity index thereof to fall within the above-mentioned range, the content of the polymer component having a number average molecular weight (Mn) of 2000 or more in the vacuum pump oils (vacuum pump oils (1) and (2)) of one embodiment of the present invention is preferably less than 3% by mass based on the total amount (100% by mass) of the vacuum pump oil, more preferably less than 1.5% by mass, even more preferably less than 0.9% by mass, and further more preferably less than 0.5% by mass.

In this description, the number average molecular weight (Mn) is a value converted in terms of a standard polystyrene as measured through gel permeation chromatography (GPC), and the measurement conditions are mentioned below.

(Measurement Conditions)

Gel permeation chromatography device: "1260 Type HPLC", manufactured by Agilent

Standard sample: polystyrene

Columns: two "Shodex LF404" columns connected in series

Column temperature: 35° C.

Developing solvent: chloroform

Flow rate: 0.3 mL/min

The vacuum pump oils (vacuum pump oils (1) and (2)) of one embodiment of the present invention may contain a synthetic oil as a base oil as long as the effects of the present invention are not impaired, and may further contain any other general-purpose additives than the components (B) and (C).

In the vacuum pump oils (vacuum pump oils (1) and (2)) of one embodiment of the present invention, the total content of the components (A), (B) and (C) is preferably 70 to 100% by mass based on the total amount (100% by mass) of the vacuum pump oil, more preferably 80 to 100% by mass, even more preferably 90 to 100% by mass, and further more preferably 97 to 100% by mass.

Hereinunder the details of the components contained in the vacuum pump oils (vacuum pump oils (1) and (2)) of the present invention are described.

<Mineral Oil (A)>

The mineral oil (A) contained in the vacuum pump oil of the present invention is so prepared as to satisfy the following requirement(I).

Requirement(I): The temperature gradient $\Delta|\eta^*|$ of complex viscosity thereof between two points of t(° C.) and t−10(° C.) (where $-15 \leq t \leq -10$), as measured using a rotary rheometer at an angular velocity of 6.3 rad/s, (hereinafter this may be referred to as "temperature gradient $\Delta|\eta^*|$ of complex viscosity") is 10 Pa·s/° C. or less.

Further, the vacuum pump oil (1) of one embodiment of the present invention is so prepared as to satisfy the following requirement(I-1), and the vacuum pump oil (2) is so prepared as to satisfy the following requirement(I-2).

Requirement(I-1): The temperature gradient $\Delta|\eta^*|$ of complex viscosity thereof between two points of −10° C. and −20° C., as measured using a rotary rheometer at an angular velocity of 6.3 rad/s, is 5 Pa·s/° C. or less.

Requirement(I-2): The temperature gradient $\Delta|\eta^*|$ of complex viscosity thereof between two points of −15° C. and −25° C., as measured using a rotary rheometer at an angular velocity of 6.3 rad/s, is 10 Pa·s/° C. or less.

The mineral oil (A) for use in the present invention may be one kind alone of mineral oil or a mixed mineral oil of two or more kinds of mineral oils.

In the case where the mineral oil (A) is a mixed mineral oil of two or more kinds of mineral oils, the mixed mineral oil need to satisfy the above-mentioned requirement(I), but so far as each mineral oil constituting the mixed mineral oil satisfies the requirement(I), it may be considered that the "mixed mineral oil also satisfies the requirement(I)".

The same shall apply to the requirements (I-1) and (I-2).

The "temperature gradient $\Delta|\eta^*|$ of complex viscosity" defined in the requirement(I) is a value indicative of an amount of change (absolute value of inclination) of complex viscosity per unit between two temperature points t(° C.) and t−10 (° C.), which is calculated by independently measuring a value of complex viscosity $\eta^*$ at t(° C.) of −15° C. or higher and −10° C. or lower and a value of complex viscosity $\eta^*$ at t−10(° C.), or by measuring the value while the temperature is continuously varied from t(° C.) to t−10(° C.) or from t−10 (° C.) to t(° C.), then plotting the values on the plane of coordinates of temperature-complex viscosity, and determining the complex viscosity change in varying the temperature by 10° C. thereon.

More specifically, the temperature gradient $\Delta|\eta^*|$ of complex viscosity means a value calculated from the following calculation formula (f1).

$$\text{Temperature gradient } \Delta|\eta^*| \text{ of complex viscosity} = |([\text{complex viscosity } \eta^* \text{ at } t(^\circ\text{C.})] - [\text{complex viscosity } \eta^* \text{ at } t-10(^\circ\text{C.})])/10| \quad \text{Calculation formula (f1):}$$

In this description, the complex viscosity $\eta^*$ at a predetermined temperature is a value measured under the above-mentioned conditions, and specifically means a value measured according to the method described in the section of Examples.

The requirements (I-1) and (I-2) are to define the temperature gradient $\Delta|\eta^*|$ of complex viscosity in the case where t in the requirement(I) is a specific value.

Namely, the requirement(I-1) that the mineral oil (A) contained in the vacuum pump oil (1) satisfies is a definition corresponding to the case of t=−10 in the requirement(I), and is to define the temperature gradient $\Delta|\eta^*|$ of complex viscosity between two points of −10° C. and −20° C.

The requirement(I-2) that the mineral oil (A) contained in the vacuum pump oil (2) satisfies is a definition corresponding to the case of t=−15 in the requirement(I), and is to define the temperature gradient $\Delta|\eta^*|$ of complex viscosity between two points of −15° C. and −25° C.

In general, when a phenol-based compound (B) and an amine-based compound (C) are blended in a mineral oil, the compounds worsen anti-emulsification performance. In the case where the degree of worsening of anti-emulsification performance is large, the resultant vacuum pump oil becomes poor in water separability. Consequently, the vacuum pump oil of the type is hardly applicable to devices that are expected to be exposed to water penetration, for example, to vacuum pumps for food processing.

Worsening of anti-emulsification performance is considered to be caused by blending with additives such as a phenol-based compound and an amine-based compound. Consequently, when such additives are not blended, worsening of anti-emulsification performance would not occur, and therefore in the case, a vacuum pump oil having good water separability could be produced.

However, the vacuum pump oil not containing such additives is problematic especially in oxidation stability and would be therefore unfavorable to long-term use at high temperatures.

For solution to such a problem, the present inventors have made assiduous studies to realize a means of inhibiting worsening of anti-emulsification performance to be caused by the presence of additives, even in the case where additives such as a phenol-based compound and an amine-based compound are blended.

With that, the present inventors have reached a finding that, by using a mineral oil (A) satisfying the above-mentioned requirement(I) as the base oil in a vacuum pump oil, worsening of the anti-emulsification performance of the vacuum pump oil to be caused by blending with additives such as a phenol-based compound (B) and an amine-based compound (C) therein can be effectively inhibited. The present invention has been attained on the basis of the finding.

The "temperature gradient $\Delta|\eta^*|$ of complex viscosity" as defined in the requirement(I) can be said to be an index that totally indicates the balance of various characteristics of the constituent components that constitute the mineral oil (for example, abundance ratio of branched isoparaffin and linear isoparaffin; aromatic content, sulfur content, nitrogen content, naphthene content; wax content; mineral oil purification level).

For example, since mineral oil contains wax, the wax fragment may precipitate to form a gel-like structure therein when the temperature of mineral oil is gradually lowered. The wax fragment contains paraffin, naphthene and others, and depending on the structure and the content thereof, the wax precipitation rate varies.

As a result of repeated studies, the present inventors have known such a tendency that the precipitation rate of the wax fragment containing a large amount of a linear paraffin (normal paraffin) is high as compared with the case containing a branched paraffin and the temperature gradient $\Delta|\eta^*|$ of complex viscosity thereof increases, while on the other hand, the precipitation rate of the wax fragment containing a large amount of a branched paraffin is low as compared with the case containing a linear paraffin and the temperature gradient $\Delta|\eta^*|$ of complex viscosity thereof decreases.

Namely, the value of the temperature gradient $\Delta|\eta^*|$ of complex viscosity can be said to be an index that indicates a ratio of linear paraffin to branched isoparaffin.

With that, the present inventor have further reached a finding that, regarding the mineral oil to be used, one having a larger proportion of a branched isoparaffin as compared with a linear normal paraffin can attain a higher effect of preventing worsening of water separability (anti-emulsification performance) owing to blending with additives such as a phenol-based compound (B) and an amine-based compound (C).

The reason may be considered to be because, when the proportion of an isoparaffin in the mineral oil to be used increases, it may impound the additives such as a phenol-based compound (B) and an amine-based compound (C) and may exhibit the same function as that of a surfactant.

The mineral oil having a large value of "temperature gradient $\Delta|\eta^*|$ of complex viscosity" as defined in the requirement(I) tends to have a large aromatic content and a large sulfur content in the mineral oil.

The presence of an aromatic content and a sulfur content may bring about a cause of worsening anti-emulsification performance. In addition, the presence may often cause sludge generation in long-term use and may degrade oxidation stability.

Namely, the value of the temperature gradient $\Delta|\eta^*|$ of complex viscosity of the mineral oil, as defined in the requirement(I), is an index for comprehensive consideration of the characteristics of various components that may have any influence on the effect of preventing worsening of water separability (anti-emulsification performance) and on oxidation stability in the case where additives are blended in the target mineral oil.

Consequently in the present invention, the mineral oil (A), as so prepared that the temperature gradient $\Delta|\eta^*|$ of complex viscosity thereof could be 10 Pa·s/° C. or less, is used to provide a vacuum pump oil well balanced in point of the water separability and the oxidation stability thereof.

Contrary to this, when additives such as a phenol-based compound (B) and an amine-based compound (C) are blended in a mineral oil whose temperature gradient $\Delta|\eta^*|$ of complex viscosity is more than 10 Pa·s/° C., the anti-emulsification performance worsens and the water separability of the resultant vacuum pump oil is poor.

From the above-mentioned viewpoints, the temperature gradient $\Delta|\eta^*|$ of complex viscosity, as defined by the requirement(I) that the mineral oil (A) contained in the vacuum pump oil of the present invention satisfies, is preferably 8.0 Pa·s/° C. or less, more preferably 5.0 Pa·s/° C. or less, even more preferably 3.0 Pa·s/° C. or less, further more preferably 2.0 Pa·s/° C. or less, and especially preferably 1.5 Pa·s/° C. or less.

Also, the temperature gradient $\Delta|\eta^*|$ of complex viscosity, as defined by the requirement(I-1) that the mineral oil (A) contained in the vacuum pump oil (1) satisfies, is 5 Pa·s/° C. or less, and is preferably 4.0 Pa·s/° C. or less, more preferably 3.0 Pa·s/° C. or less, even more preferably 2.0 Pa·s/° C. or less, further more preferably 1.0 Pa·s/° C. or less, and especially preferably 0.50 Pa·s/° C. or less.

Further, the temperature gradient $\Delta|\eta^*|$ of complex viscosity, as defined by the requirement(I-2) that the mineral oil (A) contained in the vacuum pump oil (2) satisfies, is 10 Pa·s/° C. or less, and is preferably 8.0 Pa·s/° C. or less, more preferably 5.0 Pa·s/° C. or less, even more preferably 3.0 Pa·s/° C. or less, further more preferably 2.0 Pa·s/° C. or less, and especially preferably 1.5 Pa·s/° C. or less.

The temperature gradient $\Delta|\eta^*|$ of complex viscosity, as defined by the requirement(I), the requirement(I-1) and the requirement(I-2) for the mineral oil (A), is preferably 0.05 Pa·s/° C. or more, more preferably 0.10 Pa·s/° C. or more, even more preferably 0.15 Pa·s/° C. or more, and further more preferably 0.20 Pa·s/° C. or more.

Examples of the mineral oil (A) for use in one embodiment of the present invention include atmospheric residues obtained through atmospheric distillation of crude oils such as paraffin-base crude oils, intermediate-base crude oils or naphthene-base crude oils; distillates obtained through reduced-pressure distillation of such atmospheric residues; and mineral oils or waxes (e.g., slack wax, GTL wax) obtained by purifying the distillates through one or more purification treatments of solvent deasphalting, solvent extraction, hydrofinishing, solvent dewaxing, catalytic dewaxing, isomerization dewaxing or reduced-pressure distillation.

In one embodiment of the present invention, from the viewpoint of more bettering the effect of preventing worsening of water separability (anti-emulsification performance) due to blending with additives, the mineral oil (A) preferably contains a mineral oil (A1) classified into Group 3 in the API (American Petroleum Institute) category, or a mineral oil (A2) classified into Group 2 therein.

In addition to the above-mentioned viewpoints, from the viewpoint of making the vacuum pump oil (1) or (2) conformable to the VG68 Standard and the VG46 Standard and of improving the effect of preventing sludge generation to occur in long-term use, more preferably, the mineral oil (A) contains both the mineral oil (A1) and the mineral oil (A2).

In the case where the mineral oil (A) for use in the vacuum pump oil of one embodiment of the present invention contains both the mineral oil (A1) and the mineral oil (A2), from the viewpoint of more bettering the effect of preventing worsening of water separability (anti-emulsification performance) owing to blending with additives, the content ratio of the mineral oil (A1) to the mineral oil (A2) [(A1)/(A2)] is, as a ratio by mass, preferably 50/50 to 99/1, more preferably 55/45 to 99/1, even more preferably 60/40 to 98/2, and from the viewpoint of providing a vacuum pump oil having more improved oxidation stability, the ratio is even more preferably 60/40 to 90/10, and still more preferably 60/40 to 80/20.

In particular, in the case where the mineral oil (A) for use in the vacuum pump oil (1) contains both the mineral oil (A1) and the mineral oil (A2) in one embodiment of the present invention, the content ratio of the mineral oil (A1) to the mineral oil (A2) [(A1)/(A2)] is, as a ratio by mass, preferably 50/50 to 95/5, more preferably 55/45 to 90/10, even more preferably 60/40 to 85/15, further more preferably 65/35 to 82/18.

In the case where the mineral oil (A) for use in the vacuum pump oil (2) of one embodiment of the present invention contains both the mineral oil (A1) and the mineral oil (A2), the content ratio of the mineral oil (A1) to the mineral oil (A2) [(A1)/(A2)] is, as a ratio by mass, preferably 50/50 to 99/1, more preferably 55/45 to 99/1, even more preferably 60/40 to 98/2, further more preferably 60/40 to 90/10, and still further more preferably 60/40 to 80/20.

In one embodiment of the present invention, from the viewpoint of more bettering the effect of preventing worsening of water separability (anti-emulsification performance) owing to blending with additives, the mineral oil (A2) classified into Group 2 is preferably paraffin-base mineral oil.

% $C_P$ of the mineral oil (A2) is generally 50 or more, preferably 55 or more, more preferably 60 or more, even more preferably 65 or more, and is preferably 90 or less, more preferably 85 or less, even more preferably 80 or less.

% $C_N$ of the mineral oil (A2) is preferably 10 to 40, more preferably 15 to 35, even more preferably 20 to 32.

% $C_A$ of the mineral oil (A2) is preferably 0 to 10, more preferably 0 to 5, even more preferably 0 to 2, further more preferably 0 to 1.

In this description, % $C_P$, % $C_N$ and % $C_A$ each mean a value measured according to ASTM D 3238 ring analysis (n-d-M method).

The kinematic viscosity at 40° C. of the mineral oil (A) for use in the vacuum pump oil of one embodiment of the present invention is preferably 41.4 to 74.8 $mm^2/s$, more preferably 42.0 to 74.0 $mm^2/s$, even more preferably 43.0 to 73.8 $mm^2/s$.

The viscosity index of the mineral oil (A) for use in the vacuum pump oil of one embodiment of the present invention is preferably 80 or more, more preferably 90 or more, even more preferably 100 or more, further more preferably 110 or more, and is preferably less than 160, more preferably 155 or less, even more preferably 150 or less, and further more preferably 145 or less.

The kinematic viscosity at 40° C. of the mineral oil (A) for use in the vacuum pump oil (1) of one embodiment of the present invention is, from the viewpoint of providing a vacuum pump oil conformable to VG68 Standard, preferably 61.2 to 74.8 $mm^2/s$, more preferably 61.5 to 74.0 $mm^2/s$, even more preferably 62.0 to 73.8 $mm^2/s$.

The viscosity index of the mineral oil (A) for use in the vacuum pump oil (1) is preferably 80 or more, more preferably 90 or more, even more preferably 100 or more, further more preferably 110 or more, and is preferably less than 150, more preferably 145 or less, even more preferably 140 or less, further more preferably 135 or less.

The kinematic viscosity at 40° C. of the mineral oil (A) for use in the vacuum pump oil (2) of one embodiment of the present invention is, from the viewpoint of providing a vacuum pump oil conformable to VG46 Standard, preferably 41.4 to 50.6 $mm^2/s$, more preferably 42.0 to 50.0 $mm^2/s$, even more preferably 43.0 to 49.5 $mm^2/s$.

The viscosity index of the mineral oil (A) for use in the vacuum pump oil (2) is preferably 80 or more, more preferably 90 or more, even more preferably 100 or more, further more preferably 110 or more, and is preferably less than 160, more preferably 155 or less, even more preferably 150 or less, and further more preferably 145 or less.

In the vacuum pump oils (vacuum pump oils (1) and (2)) of one embodiment of the present invention, the content of the mineral oil (A) is, based on the total amount(100% by mass) of the vacuum pump oil, preferably 65% by mass or more, more preferably 70% by mass or more, even more preferably 75% by mass or more, further more preferably 80% by mass or more, still further more preferably 85% by mass or more, even further more preferably 90% by mass or more, and is preferably 99.98% by mass or less, more preferably 99.90% by mass or less, and even more preferably 99.00% by mass or less.

<Preparation Example for Mineral Oil (A) Satisfying Requirement(I)>

The mineral oil (A) satisfying the requirement(I) (also including the mineral oil (A) satisfying the requirement(I-1) or (I-2)) may be prepared, appropriately taking the following matters into consideration. The following matters are examples for the preparation method, and the mineral oil may also be prepared in consideration of any others than these matters.

(1) Choice of Raw Material Oil as Raw Material for Mineral Oil (A)

The raw material oil of a raw material for the mineral oil (A) is preferably a raw material oil containing a petroleum-derived wax (e.g., slack wax), and a raw material oil containing a petroleum-derived wax and a bottom oil. A raw material oil containing a solvent-dewaxed oil is also usable.

The mineral oil (A) contained in the vacuum pump oil of one embodiment of the present invention is preferably one obtained by purifying a raw material oil that contains a petroleum-derived wax.

In the case where a raw material oil containing a petroleum-derived wax and a bottom oil is used, the content ratio of the wax to the bottom oil [wax/bottom oil] in the raw material oil is, as a ratio by mass, preferably 50/50 to 99/1, more preferably 60/40 to 98/2, even more preferably 70/30 to 97/3, and further more preferably 80/20 to 95/5.

When the proportion of the bottom oil increases in the raw material oil, the value of temperature gradient $\Delta|\eta^*|$ of complex viscosity, as defined in the requirement(I) for the mineral oil, tends to increase.

The bottom oil includes a bottom fraction obtained in producing a naphtha-gas oil by hydrocracking a heavy fuel oil obtained in a reduced-pressure distillation device in a production process for ordinary fuel oil from a crude oil as a starting material, and is, from the viewpoint of reducing an aromatic content, a sulfur content and a nitrogen content, preferably a bottom fraction obtained by hydrocracking a heavy fuel oil.

The wax includes, in addition to the wax isolated from the above-mentioned bottom fraction by solvent-dewaxing treatment, a wax obtained through solvent-dewaxing of an atmospheric residue obtained by atmospheric distillation of a crude oil such as a paraffin-base mineral oil, an intermediate-base mineral oil or a naphthene-base mineral oil; a wax obtained by solvent-dewaxing of a distillate obtained through reduced-pressure distillation of the atmospheric residue; a wax obtained by solvent-dewaxing a solvent-deasphalted, solvent-extracted or hydrogenation-finished product of the distillate; and a GTL wax obtained through Fischer-Tropsch synthesis.

On the other hand, as the solvent-dewaxed oil, there is exemplified a residue after solvent-dewaxing of the above-mentioned bottom fraction followed by separation and removal of the above-mentioned wax. In addition, the solvent-dewaxed oil is one having been subjected to a purification process by solvent-dewaxing and is different from the above-mentioned bottom oil.

The method for obtaining a wax through solvent-dewaxing is preferably a method in which, for example, a bottom fraction is mixed with a mixed solvent of methyl ethyl ketone and toluene, and the precipitate is removed while agitating the mixture in a low temperature region.

Specifically, the temperature in a low-temperature environment in solvent-dewaxing is preferably lower than the temperature in an ordinary solvent-dewaxing process, and is, specifically, preferably −25° C. or lower, more preferably −30° C. or lower.

The oily fraction in the raw material oil is preferably 5 to 55% by mass, more preferably 7 to 45% by mass, even more preferably 10 to 35% by mass, further more preferably 15 to 32% by mass, and especially more preferably 21 to 30% by mass.

(2) Setting of Purification Condition for Raw Material Oil

Preferably, the above-mentioned raw material oil is purified.

Preferably, the purification treatment includes at least one of hydrogenation isomerization dewaxing treatment and hydrogenation treatment. Depending on the kind of the raw material oil to be used, preferably, the kind and the purification condition for the purification treatment are appropriately set.

More specifically, depending on the kind of the raw material oil to be used, the purification treatment is chosen preferably as follows.

In the case of using a raw material oil (α) that contains a petroleum-derived wax and a bottom oil in the above-mentioned content ratio, preferably, the raw material oil (α) is subjected to a purification treatment containing both a hydrogenation isomerization dewaxing treatment and a hydrogenation treatment is carried out.

In the case of using a raw material (β) containing a solvent-dewaxed oil, preferably, the raw material oil (β) is subjected to a purification treatment containing a hydrogenation treatment alone but not containing a hydrogenation isomerization dewaxing treatment.

The above-mentioned raw material (α) contains a bottom oil, and therefore the aromatic content, the sulfur content and the nitrogen content therein tend to increase.

Through the hydrogenation isomerization dewaxing treatment, the aromatic fraction, the sulfur fraction and the nitrogen fraction may be removed to thereby reduce the content of these fractions.

By the hydrogenation isomerization dewaxing treatment, the linear paraffin in the wax contained in a mineral oil can be converted into a branched isoparaffin, and the mineral oil (A) satisfying the requirement(I) is easy to prepare.

On the other hand, the raw material oil (β) contains a wax, but a linear paraffin has been separated and removed therefrom through precipitation by solvent-dewaxing treatment in a low-temperature environment, and therefore the content of a linear paraffin that may have an influence on the value of the complex viscosity defined in the requirement(I) is small. Consequently, the necessity of "hydrogenation isomerization dewaxing treatment" for the raw material oil of the type is low.

(Hydrogenation Isomerization Dewaxing Treatment)

As described above, the hydrogenation isomerization dewaxing treatment is a purification treatment to be carried out for the purpose of isomerization of the linear paraffin contained in the raw material oil into a branched isoparaffin, ring-opening of the aromatic fraction to convert it into a paraffin fraction, and removal of impurities such as sulfur fraction and nitrogen fraction. In particular, the presence of a linear paraffin is one cause of increasing the value of temperature gradient $\Delta|\eta^*|$ of complex viscosity defined in the requirement(I), and therefore in the present treatment, the linear paraffin is isomerized into a branched isoparaffin so as to lower the value of temperature gradient $\Delta|\eta^*|$ of complex viscosity.

Preferably, the hydrogenation isomerization dewaxing treatment is carried out in the presence of a hydrogenation isomerization dewaxing catalyst.

Examples of the hydrogenation isomerization dewaxing catalyst include a catalyst prepared by making a metal oxide of nickel (Ni)/tungsten (w), nickel (Ni)/molybdenum (Mo), cobalt(Co)/molybdenum (Mo) or the like or a noble metal of platinum (Pt), lead (Pb) or the like supported by a carrier such as silica aluminophosphate (SAPO) or zeolite.

The hydrogen partial pressure in the hydrogenation isomerization dewaxing treatment is preferably 2.0 to 220 MPa, more preferably 10 to 100 MPa, even more preferably 10 to 50 MPa, still more preferably 10 to 25 MPa.

The reaction temperature in the hydrogenation isomerization dewaxing treatment is preferably set higher than the reaction temperature in an ordinary hydrogenation isomerization dewaxing treatment and is, specifically, preferably 270 to 480° C., more preferably 280 to 420° C., even more preferably 290 to 400° C., further more preferably 300 to 370° C.

When the reaction temperature is high, isomerization of the linear paraffin existing in the raw material oil into branched isoparaffin can be accelerated to facilitate the preparation of the mineral oil (A) satisfying the requirement (I).

The liquid hourly space velocity (LHSV) in the hydrogenation isomerization dewaxing treatment is preferably 5.0 $hr^{-1}$ or less, more preferably 2.0 $hr^{-1}$ or less, even more preferably 1.5 $hr^{-1}$ or less, and further more preferably 1.0 $hr^{-1}$ or less.

From the viewpoint of increasing productivity, LHSV in the hydrogenation isomerization dewaxing treatment is preferably 0.1 $hr^{-1}$ or more, more preferably 0.2 $hr^{-1}$ or more.

The supply ratio of the hydrogen gas in the hydrogenation isomerization dewaxing treatment is, relative to 1 kiloliter of the raw material oil to be supplied, preferably 100 to 1,000 $Nm^3$, more preferably 300 to 800 $Nm^3$, even more preferably 300 to 650 $Nm^3$.

For removing the light distillate therefrom, the resultant oil after the hydrogenation isomerization dewaxing treatment may be subjected to reduced-pressure distillation.

(Hydrogenation Treatment)

Hydrogenation treatment is a purification treatment to be carried out for the purpose of complete saturation of the aromatic fraction contained in the raw material oil and removal of impurities such as the sulfur fraction and the nitrogen fraction therein.

Preferably, the hydrogenation treatment is carried out in the presence of a hydrogenation catalyst.

Examples of the hydrogenation catalyst include a catalyst prepared by making a metal oxide of nickel (Ni)/tungsten (W), nickel (Ni)/molybdenum (Mo), cobalt(Co)/molybdenum (Mo) or the like or a noble metal of platinum (Pt), lead (Pb) or the like supported by an amorphous carrier such as silica/alumina or alumina or by a crystalline carrier such as zeolite.

The hydrogen partial pressure in the hydrogenation treatment is preferably set higher than the pressure in a general hydrogenation treatment, and is, specifically, preferably 16

MPa or more, more preferably 17 MPa or more, even more preferably 20 MPa or more, and is also preferably 30 MPa or less, more preferably 22 MPa or less.

The reaction temperature in the hydrogenation treatment is preferably 200 to 400° C., more preferably 250 to 350° C., even more preferably 280 to 330° C.

The liquid hourly space velocity (LHSV) in the hydrogenation treatment is preferably 5.0 $hr^{-1}$ or less, more preferably 2.0 $hr^{-1}$ or less, even more preferably 1.0 $hr^{-1}$ or less, and is, from the viewpoint of productivity, preferably 0.1 $hr^{-1}$ or more, more preferably 0.2 $hr^{-1}$ or more, even more preferably 0.3 $hr^{-1}$ or more.

The supply ratio of the hydrogen gas in the hydrogenation treatment is, relative to 1 kiloliter of the product oil obtained in the supply step (3), preferably 100 to 1000 $Nm^3$, more preferably 200 to 800 $Nm^3$, even more preferably 250 to 650 $Nm^3$.

For removing the light distillate therefrom, the resultant oil after the hydrogenation treatment may be subjected to reduced-pressure distillation. The conditions (such as pressure, temperature, time) for the reduced-pressure distillation may be appropriately controlled so that the kinematic viscosity at 40° C. of the mineral oil (A) could fall within a desired range.

<Synthetic Oil>

The vacuum pump oil of one embodiment of the present invention may contain, as the base oil therein, a synthetic oil along with the mineral oil (A) as long as the effects of the present invention are not impaired.

Examples of the synthetic oil include a poly-α-olefin (PAO), an ester-based compound, an ether-based compound, a polyglycols, an alkylbenzene, and an alkylnaphthalene.

The content of the synthetic oils is, relative to 100 parts by mass of the mineral oil (A) contained in the vacuum pump oils (vacuum pump oil (1) and (2)), preferably 0 to 30 parts by mass, more preferably 0 to 20 parts by mass, even more preferably 0 to 10 parts by mass, further more preferably 0 to 5 parts by mass.

<Phenol-Based Compound (B)>

The phenol-based compound (B) for use in the present invention may be a compound having a phenol structure, and may be a monocyclic phenol-based compound or a polycyclic phenol-based compound.

In one embodiment of the present invention, the component(B) may be used singly, or two or more kinds thereof may be used in combination.

Examples of the monocyclic phenol-based compound include 2,6-di-t-butyl-4-methylphenol, 2,6-di-t-butyl-4-ethylphenol, 2,4,6-tri-t-butylphenol, 2,6-di-t-butyl-4-hydroxymethylphenol, 2,6-di-t-butylphenol, dimethyl-6-t-butylphenol, 2,6-Di-t-butyl-4-(N, N-dimethylaminomethyl) phenol, 2,6-di-t-amyl-4-methylphenol, and benzenepropanoic acid 3,5-bis(1,1-dimethylethyl)-4-hydroxyalkyl ester.

Examples of the polycyclic phenol-based compound include 4,4'-methylenebis(2,6-di-t-butylphenol), 4,4'-isopropylidenebis(2,6-di-t-butylphenol), 2,2'-methylenebis(4-methyl-6-t-butylphenol), 4,4'-bis(2,6-di-t-butylphenol), 4,4'-bis(2-methyl-6-t-butylphenol), 2,2'-methylenebis(4-ethyl-6-t-butylphenol), and 4,4'-butylidenebis(3-methyl-6-t-butylphenol).

In the vacuum pump oil of one embodiment of the present invention, the phenol-based compound (B) is preferably a hindered phenol compound having at least one structure represented by the following formula (b-1) in one molecule, and is more preferably benzenepropanoic acid 3,5-bis(1,1-dimethylethyl)-4-hydroxyalkyl ester.

(b-1)

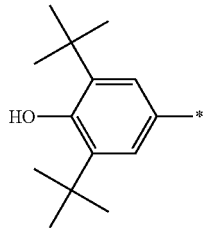

In the above formula (b-1), * indicates a bonding position.

In one embodiment of the present invention, from the viewpoint of providing a vacuum pump oil having a high ultimate vacuum degree, the molecular weight of the phenol-based compound (B) is preferably 100 to 1,000, more preferably 150 to 900, even more preferably 200 to 800, and still more preferably 250 to 700.

<Amine-Based Compound (C)>

The amine-based compound (C) for use in one embodiment of the present invention is, from the viewpoint of providing a vacuum pump oil having more improved oxidation stability, preferably an aromatic amine compound, and more preferably one or more selected from a diphenylamine compound and a naphthylamine compound.

In one embodiment of the present invention, the component(C) may be used singly, or two or more kinds thereof may be used in combination.

Examples of the diphenylamine-based compound include a monoalkyldiphenylamine-based compound having one alkyl group having 1 to 30 (preferably 4 to 30, more preferably 8 to 30) carbon atoms such as monooctyldiphenylamine and monononyldiphenylamine; a dialkyldiphenylamine compound having two alkyl groups each having 1 to 30 (preferably 4 to 30, more preferably 8 to 30) carbon atoms such as 4,4'-dibutyldiphenylamine, 4,4'-dipentyldiphenylamine, 4,4'-dihexyldiphenylamine, 4,4'-diheptylphenylamine, 4,4'-dioctyldiphenylamine and 4,4'-dinonyldiphenylamine; a polyalkyldiphenylamine-based compound having 3 or more alkyl groups each having 1 to 30 (preferably 4 to 30, more preferably 8 to 30) carbon atoms such and tetrabutyldiphenylamine, tetrahexyldiphenylamine, tetraoctyldiphenylamine, and tetranonyldiphenylamine; and 4,4'-bis(α,α-dimethylbenzyl)diphenylamine.

Examples of the naphthylamine-based compound include 1-naphthylamine, phenyl-1-naphthylamine, butylphenyl-1-naphthylamine, pentylphenyl-1-naphthylamine, hexylphenyl-1-naphthylamine, heptylphenyl-1-naphthylamine, octylphenyl-1-naphthylamine, nonylphenyl-1-naphthylamine, decylphenyl-1-naphthylamine, and dodecylphenyl-1-naphthylamine.

In the vacuum pump oil of one embodiment of the present invention, the amine-based compound (C) is preferably a diphenylamine-based compound, and more preferably a dialkyldiphenylamine compound having 2 alkyl groups each having 1 to 30 (preferably 1 to 20, more preferably 1 to 10) carbon atoms.

In one embodiment of the present invention, from the viewpoint of providing a vacuum pump oil having a high ultimate vacuum degree, the molecular weight of the amine-based compound (C) is preferably 100 to 1,000, more preferably 150 to 900, even more preferably 200 to 800, still more preferably 250 to 700.

<Content of Components (B) and (C)>

The vacuum pump oils (vacuum pump oils (1) and (2)) of the present invention contain one or more compounds selected from a phenol-based compound (B) and an amine-based compound (C), and from the viewpoint of providing a vacuum pump oil having more improved oxidation stability, preferably contain at least a phenol-based compound (B), more preferably both a phenol-based compound (B) and an amine-based compound (C).

In the vacuum pump oils (vacuum pump oils (1) and (2)) of the embodiments of the present invention, the content of the component(B) is, from the viewpoint of providing a vacuum pump oil having well-balanced water separability and oxidation stability, preferably 0.01 to 10% by mass based on the total amount(100% by mass) of the vacuum pump oil, more preferably 0.03 to 5% by mass, even more preferably 0.05 to 2% by mass, still more preferably 0.07 to 1% by mass.

In the vacuum pump oils (vacuum pump oils (1) and (2)) of one embodiment of the present invention, the content of the component(C) is, from the viewpoint of providing a vacuum pump oil having well-balanced water separability and oxidation stability, preferably 0.01 to 10% by mass based on the total amount(100% by mass) of the vacuum pump oil, more preferably 0.05 to 5% by mass, even more preferably 0.07 to 2% by mass, still more preferably 0.10 to 1% by mass.

Also in the vacuum pump oils (vacuum pump oils (1) and (2)) of one embodiment of the present invention, the content ratio of the component(B) to the component(C) [(B)/(C)] is, from the viewpoint of providing a vacuum pump oil having more improved oxidation stability, preferably 1/4 to 6/1 as a ratio by mass, more preferably 1/3 to 5/1, even more preferably 1/2 to 4/1, still more preferably 1/1 to 3/1.

In the vacuum pump oils (vacuum pump oils (1) and (2)) of one embodiment of the present invention, the total content of the components (B) and (C) is, from the viewpoint of providing a vacuum pump oil having well-balanced water separability and oxidation stability, preferably 0.02 to 15% by mass based on the total amount(100% by mass) of the vacuum pump oil, more preferably 0.05 to 10% by mass, even more preferably 0.10 to 5% by mass, still more preferably 0.15 to 2% by mass.

<General-Purpose Additives>

The vacuum pump oils (vacuum pump oils (1) and (2)) of one embodiment of the present invention may further contain, if desired, any other general-purpose additives than the components (B) and (C) as long as the effects of the present invention are not impaired.

Examples of such general-purpose additives include, except the components (B) and (C), an antioxidant, a metal deactivator, and an anti-foaming agent.

These general-purpose additives may be used singly, or two or more kinds thereof may be used in combination.

The content of each general-purpose additive may be appropriately controlled depending on the kind of the general-purpose additive as long as the effects of the present invention are not impaired.

In the vacuum pump oils (vacuum pump oils (1) and (2)) of one embodiment of the present invention, the total content of the general-purpose additives is preferably 0 to 30% by mass based on the total amount(100% by mass) of the vacuum pump oil, more preferably 0 to 20% by mass, even more preferably 0 to 10% by mass, still more preferably 0 to 3% by mass.

[Various Properties of Vacuum Pump Oil]

The kinematic viscosity at 40° C. of the vacuum pump oil of one embodiment of the present invention is preferably 41.4 to 74.8 $mm^2/s$, more preferably 42.0 to 74.0 $mm^2/s$, even more preferably 43.0 to 73.8 $mm^2/s$.

The vacuum pump oil of one embodiment of the present invention is preferably the vacuum pump oil (1) conformable to VG68 Standard of the viscosity grade defined in ISO 3448, and the vacuum pump oil (2) conformable to VG46 Standard thereof.

The kinematic viscosity at 40° C. of the vacuum pump oil (1) of one embodiment of the present invention is preferably 61.2 to 74.8 $mm^2/s$, more preferably 61.5 to 74.0 $mm^2/s$, even more preferably 62.0 to 73.8 $mm^2/s$.

The kinematic viscosity at 40° C. of the vacuum pump oil (2) of one embodiment of the present invention is preferably 41.4 to 50.6 $mm^2/s$, more preferably 42.0 to 50.0 $mm^2/s$, even more preferably 43.0 to 49.5 $mm^2/s$.

In the vacuum pump oils (vacuum pump oils (1) and (2)) of one embodiment of the present invention, the sulfur atom content is, from the viewpoint of providing a vacuum pump oil capable of preventing sludge generation in long-term use and excellent in oxidation stability, preferably less than 200 ppm by mass based on the total amount(100% by mass) of the vacuum pump oil, more preferably less than 100 ppm by mass, even more preferably less than 50 ppm by mass, and further more preferably less than 10 ppm by mass.

In this description, the sulfur atom content means a value measured according to JIS K2541-6.

The RPVOT value of the vacuum pump oils (vacuum pump oils (1) and (2)) of one embodiment of the present invention is preferably 200 minutes or more, more preferably 220 minutes or more, even more preferably 240 minutes or more.

In this description, the RPVOT value of the vacuum pump oil means a value measured according to the rotating pressure vessel oxidation test(RPVOT) of JIS K2514-3 under the conditions described in the section of Examples given hereinunder.

In the water separability test according to JIS K2520 at a temperature of 54° C. for the vacuum pump oils (vacuum pump oils (1) and (2)) of one embodiment of the present invention, the anti-emulsification degree of the vacuum pump oil that indicates the time taken until the emulsion layer reaches 3 mL is preferably less than 20 minutes, more preferably 15 minutes or less, even more preferably 10 minutes or less, and still more preferably 5 minutes or less.

The ultimate vacuum degree, as measured according to JIS B8316, of the vacuum pump oils (vacuum pump oils (1) and (2)) of one embodiment of the present invention is preferably less than 0.6 Pa, more preferably less than 0.5 Pa, even more preferably less than 0.4 Pa.

[Use of Vacuum Pump Oil]

The vacuum pump oil of the present invention has a good ultimate vacuum degree and is excellent in water separability, oxidation stability, and shear stability. Accordingly, the vacuum pump oil of the present invention can have well-balanced such characteristics and is applicable to various applications.

The applications of the vacuum pump oil are not limited specifically, and the vacuum pump oil is favorable as a lubricating oil for vacuum pumps for use in production of semiconductors, solar cells, airplanes, automobiles, and foods that require vacuum packaging or retort processing.

The vacuum pump oil is not limited specifically, and examples thereof include oil rotary vacuum pumps, mechanical booster pumps, dry pumps, diaphragm vacuum pumps, turbo molecular pumps, ejector (vacuum) pumps, oil diffusion pumps, sorption pumps, titanium sublimation pumps, sputtering ion pumps, cryopumps, rocking piston-type dry vacuum pumps, rotor-type dry vacuum pumps, and scroll-type dry vacuum pumps.

Namely, the present invention can also provide a vacuum pump of the following (i) and a method for using a vacuum pump oil of the following (ii).

(i) A vacuum pump for production of semiconductors, solar cells, airplanes, automobiles or foods, using a vacuum pump oil which contains:

a mineral oil (A) having a temperature gradient $\Delta|\eta^*|$ of complex viscosity between two points of t(° C.) and t−10(° C.) (where $-15 \leq t \leq -10$), as measured using a rotary rheometer at an angular velocity of 6.3 rad/s, of 10 Pa·s/° C. or less, and one or more compounds selected from a phenol-based compound (B) and an amine-based compound (C); and has a viscosity index of less than 160.

(ii) A method of using a vacuum pump oil, including using a vacuum pump oil in a vacuum pump for production of semiconductors, solar cells, airplanes, automobiles or foods, wherein the vacuum pump oil contains:

a mineral oil (A) having a temperature gradient $\Delta|\eta^*|$ of complex viscosity between two points of t(° C.) and t−10(° C.) (where $-15 \leq t \leq -10$), as measured using a rotary rheometer at an angular velocity of 6.3 rad/s, of 10 Pa·s/° C. or less, and one or more compounds selected from a phenol-based compound (B) and an amine-based compound (C); and has a viscosity index of less than 160.

The present invention can also provide a vacuum pump of the following (i-1) and a method for using a vacuum pump oil of the following (ii-1), using a vacuum pump oil conformable to VG68 Standard.

(i-1) A vacuum pump for production of semiconductors, solar cells, airplanes, automobiles or foods, using a vacuum pump oil (1) which contains:

a mineral oil (A) having a temperature gradient $\Delta|\eta^*|$ of complex viscosity between two points of −10° C. and −20° C., as measured using a rotary rheometer at an angular velocity of 6.3 rad/s, of 5 Pa·s/° C. or less, and one or more compounds selected from a phenol-based compound (B) and an amine-based compound (C); and has a viscosity index of less than 150.

(ii-1) A method of using a vacuum pump oil, including using a vacuum pump oil (1) in a vacuum pump for production of semiconductors, solar cells, airplanes, automobiles or foods, wherein the vacuum pump oil (1) contains:

a mineral oil (A) having a temperature gradient $\Delta|\eta^*|$ of complex viscosity between two points of −10° C. and −20° C., as measured using a rotary rheometer at an angular velocity of 6.3 rad/s, of 5 Pa·s/° C. or less, and one or more compounds selected from a phenol-based compound (B) and an amine-based compound (C); and has a viscosity index of less than 150.

Further, the present invention can also provide a vacuum pump of the following (i-2) and a method for using a vacuum pump oil of the following (ii-2), using a vacuum pump oil conformable to VG46 Standard.

(i-2) A vacuum pump for production of semiconductors, solar cells, airplanes, automobiles or foods, using a vacuum pump oil (2) which contains:

a mineral oil (A) having a temperature gradient $\Delta|\eta^*|$ of complex viscosity between two points of −15° C. and −25° C., as measured using a rotary rheometer at an angular velocity of 6.3 rad/s, of 10 Pa·s/° C. or less, and one or more compounds selected from a phenol-based compound (B) and an amine-based compound (C); and has a viscosity index of less than 160.

(ii-2) A method of using a vacuum pump oil, including using a vacuum pump oil (2) in a vacuum pump for production of semiconductors, solar cells, airplanes, automobiles or foods, wherein the vacuum pump oil (2) contains:

a mineral oil (A) having a temperature gradient $\Delta|\eta^*|$ of complex viscosity between two points of −15° C. and −25° C., as measured using a rotary rheometer at an angular velocity of 6.3 rad/s, of 10 Pa·s/° C. or less, and one or more compounds selected from a phenol-based compound (B) and an amine-based compound (C); and has a viscosity index of less than 160.

[Method for Producing Vacuum Pump Oil]

As the method for producing the vacuum pump oil of the present invention, there may be mentioned a method including a step of blending one or more compounds selected from a phenol-based compound (B) and an amine-based compound (C) in a mineral oil (A) satisfying the above-mentioned requirement(I).

In the method, if desired, the above-mentioned general-purpose additives may be blended.

The preferred compounds, the physical data and the blending ratio of the components (A) to (C) and various properties of the resultant vacuum pump oil are as mentioned above.

EXAMPLES

The present invention is hereunder described in more detail by reference to Examples, but it should be construed that the present invention is by no means limited by the following Examples. The measurement methods and evaluation methods of various physical properties are as follows.

<Properties of Base Oil or Vacuum Pump Oil>

(1) Kinematic Viscosities at 40° C. and 100° C.

Measured in conformity with JIS K2283.

(2) Viscosity Index

Measured in conformity with JIS K2283.

<Properties of Base Oil>

(3) Aromatic Content(% $C_A$), Paraffin Content(% $C_P$), Naphthene Content(% $C_N$)

Measured through ring analysis (n-d-M method) of ASTM D3238.

(4) Measurement of Complex Viscosity $\eta^*$

Measured with a rheometer, "Physica MCR 301", manufactured by Anton Paar according to the following procedures.

First of all, a sample oil to be measured was inserted in a cone plate (diameter: 50 mm, tilt angle: 1°) that had been adjusted to a measurement temperature of −10° C., −15° C., −20° C. and −25° C. and then held at the measurement temperature for 10 minutes. On this occasion, care was taken so as not to induce a strain in the inserted solution.

The complex viscosity $\eta^*$ was then measured at the predetermined measurement temperatures in a vibration mode at an angular velocity of 6.3 rads and a strain amount set as follows at each measurement temperature.

(Strain Amount Set at Each Measurement Temperature)

Strain amount at −10° C.: 2.1%

Strain amount at −15° C.: 1.17%

Strain amount at −20° C.: 0.65%

Strain amount at −15° C.: 0.36%

The "temperature gradient $\Delta|\eta^*|$ of complex viscosity between two points of −10° C. and −20° C.", corresponding to the case of t=−10, was then calculated from the values of complex viscosity $\eta^*$ at −10° C. and −20° C. according to the aforementioned calculation formula (f1).

Similarly, the "temperature gradient $\Delta|\eta^*|$ of complex viscosity between two points of −15° C. and −25° C.", corresponding to the case of t=−15, was calculated from the values of complex viscosity η* at −15° C. and −25° C. according to the calculation formula (f1).

<Properties of Vacuum Pump Oil>

(4) Sulfur Atom Content

Measured according to JIS K2541-6.

<Characteristics of Vacuum Pump Oil>

(6) RPVOT Value

According to the rotating pressure vessel oxidation test (RPVOT) of JIS K2514-3, the vacuum pump oil was tested at a test temperature of 150° C. under an initial pressure of 620 kPa, and the time taken until the pressure lowered from the highest pressure by 175 kPa (RPVOT value) was measured. A longer time of the value means that the vacuum pump oil tested has more excellent oxidation stability.

(7) Anti-Emulsification Degree

According to JIS K2520, the vacuum pump oil was tested in a water separability test at a temperature of 54° C. Table 1 shows "volume of oily layer (ml)", "volume of aqueous layer (ml)", "volume of emulsion layer (ml)" and "lapse time (min)" in that order.

(8) Ultimate Vacuum Degree

Measured according to JIS B8316. Specifically, the compressor part of an oil-sealed rotary vacuum pump was filled with a vacuum pump oil, then the vacuum pump was driven, and the vacuum degree at the intake port after 1 hour was measured to be "ultimate vacuum degree".

<Various Tests for Vacuum Pump Oil>

(9) Shear Stability Test

Based on the ultrasonic B method (JPT-55-29), the vacuum pump oil was tested under the measurement conditions of an ultrasonic exposure time of 30 minutes, a room temperature (25° C.) and an oil amount of 30 ml. The output voltage for the ultrasonic waves in the shear stability test was so controlled that after 30 ml of a standard oil was exposed to ultrasonic waves for 10 minutes, the kinematic viscosity reduction rate at 40° C. thereof could be 15%.

The kinematic viscosity at 40° C. and 100° C. and the viscosity index before and after the shear stability test were measured, and the kinematic viscosity reduction rate at each temperature was calculated according to the following formula.

Formula:

$$\text{Shear stability}(\%)=([\text{kinematic viscosity before test}]-[\text{kinematic viscosity after test}]/[\text{kinematic viscosity before test}])\times 100$$

A lower value of kinematic viscosity reduction rate means that the vacuum pump oil has more excellent shear stability. The kinematic viscosity at 40° C. and 100° C. and the viscosity index were measured according to JIS K2283.

(10) Indiana Oxidation Test(IOT)

According to an Indiana oxidation test, 300 ml of a sample oil of the vacuum pump oil and catalysts of an iron catalyst and a copper catalyst were put in a sample vessel, and while air was blown thereinto via an air-blowing tube at 10 L/h, this was heated at 150° C. for 24 hours.

The kinematic viscosity at 40° C., the acid number increase, the RPVOT value and the Millipore value of the sample oil after the test were measured according to the following methods.

"Kinematic Viscosity at 40° C.":

Measured according to JIS K2283.

"Acid Number Increase":

The acid number of the sample oil was measured before and after the test according to JIS K2501 (indicator method), and the difference therebetween was calculated.

"RPVOT Value":

According to the rotating pressure vessel oxidation test (RPVOT) of JIS K2514-3, the vacuum pump oil was tested at a test temperature of 150° C. under an initial pressure of 620 kPa, and the time taken until the pressure lowered from the highest pressure by 175 kPa (RPVOT value) was measured.

"Millipore Value":

According to SAE-ARP-785-63, the precipitate in 300 ml of the test oil after the above-mentioned test was collected through filtration, and from the mass thereof, the mass of the precipitate per 100 ml of the sample oil was calculated as "millipore value".

Examples I-1 to I-3, Comparative Examples I-1 to I-5

Various additives shown in Table 1 were blended with the base oil shown in Table 1 at the blending ratio also shown therein to prepare vacuum pump oils.

The details of the base oils and the additives used herein are as follows.

<Base Oil>

Mineral Oil (1-1):

This is a paraffin-base mineral oil classified into Group 2 in the API category, which is obtained by hydrogenation isomerization dewaxing treatment of a raw material oil of a distillate of 1860 neutral or more containing a slack wax and a bottom oil obtained through hydrocracking of a heavy fuel oil, followed by hydrogenation finishing treatment. 40° C. kinematic viscosity=408.8 $mm^2/s$, viscosity index=107, % $C_A$=0, % $C_P$=70.0, % $C_N$=30.0.

The conditions for the hydrogenation isomerization dewaxing treatment are as follows.

Hydrogen gas supply ratio: 250 $Nm^3$ or more and less than 300 $Nm^3$ relative to 1 kiloliter of the supplied starting material oil Hydrogen partial pressure: 3 MPa or more and less than 10 MPa Liquid hourly space velocity (LHSV): 0.5 $hr^{-1}$ to 1.0 $hr^{-1}$ Reaction temperature: 300° C. to 350° C.

Mineral Oil (1-2):

This is a paraffin-base mineral oil classified into Group 2 in the API category, which is obtained by hydrogenation isomerization dewaxing treatment of a raw material oil of a mixed oil obtained by mixing a distillate of 150 neutral or more and a distillate of 500 neutral or more and containing a slack wax and a bottom oil obtained through hydrocracking of a heavy fuel oil, followed by hydrogenation finishing treatment. 40° C. kinematic viscosity=75.2 $mm^2/s$, viscosity index=98, % $C_A$=5.3, % $C_P$=66.8, % $C_N$=27.9.

The conditions for the hydrogenation isomerization dewaxing treatment are as follows.

Hydrogen gas supply ratio: 250 $Nm^3$ or more and less than 300 $Nm^3$ relative to 1 kiloliter of the supplied starting material oil Hydrogen partial pressure: 3 MPa or more and less than 10 MPa Liquid hourly space velocity (LHSV): 0.5 $hr^{-1}$ to 1.0 $hr^{-1}$ Reaction temperature: 300° C. to 350° C.

Mineral Oil (1-3):

This is a mineral oil classified into Group 3 in the API category, which is obtained by hydrogenation isomerization dewaxing treatment of a raw material oil of a distillate of 200 neutral or more containing a slack wax and a bottom oil obtained through hydrocracking of a heavy fuel oil, followed by hydrogenation finishing treatment. 40° C. kinematic viscosity=43.75 $mm^2/s$, viscosity index=143, % $C_A$=0, % $C_P$=94.7, % $C_N$=6.3.

The conditions for the hydrogenation isomerization dewaxing treatment are as follows.

Hydrogen gas supply ratio: 300 $Nm^3$ to 400 $Nm^3$ relative to 1 kiloliter of the supplied starting material oil Hydrogen partial pressure: 10 MPa to 15 MPa Liquid hourly space velocity (LHSV): 0.5 $hr^{-1}$ to 1.0 $hr^{-1}$ Reaction temperature: 300° C. to 350° C.

<Various Additives>

Phenol-based compound: benzenepropanoic acid 3,5-bis(1,1-dimethylethyl)-4-hydroxyalkyl ester Amine-based compound: 4,4'-dioctyldiphenylamine Metal deactivator: 2-(2-hydroxy-4-methylphenyl)benzotriazole Polymer component: viscosity index improver having a resin content of 4.9% by mass, prepared by diluting polyisobutene having Mn of 320,000 with 150 N mineral oil

TABLE 1

| | | | | Example | | | Comparative Example |
|---|---|---|---|---|---|---|---|
| | | | | I-1 | I-2 | I-3 | I-1 |
| Composition of Vacuum Pump Oil | Base Oil | Mineral oil (1-1) | mass % | 24.69 | 28.69 | 19.69 | — |
| | | Mineral oil (1-2) | mass % | — | — | — | 99.69 |
| | | Mineral oil (1-3) | mass % | 75.00 | 71.00 | 80.00 | — |
| | Additives | Phenol-based compound | mass % | 0.20 | 0.20 | 0.20 | 0.20 |
| | | Amine-based compound | mass % | 0.10 | 0.10 | 0.10 | 0.10 |
| | | Metal deactivator | mass % | 0.01 | 0.01 | 0.01 | 0.01 |
| | | Polymer component | mass % | — | — | — | — |
| | Total | | mass % | 100.00 | 100.00 | 100.00 | 100.00 |
| Properties of Base Oil | Temperature gradient Δ\|η*\| of complex viscosity between two points of −10° C. and −20° C. | | Pa · s/° C. | 0.287 | 0.277 | 0.292 | 176.1 |
| Properties of Vacuum Pump Oil | 40° C. Kinematic viscosity | | $mm^2/s$ | 68.25 | 73.91 | 62.26 | 66.5 |
| | 100° C. Kinematic viscosity | | $mm^2/s$ | 10.08 | 10.62 | 9.532 | 8.787 |
| | Viscosity index | | — | 132 | 130 | 135 | 105 |
| | Sulfur atom content | | mass ppm | less than 10 | less than 10 | less than 10 | 2000 |
| Characteristics of Vacuum Pump Oil | RPVOT value | | min | 259 | 245 | 261 | 244 |
| | Anti-emulsification degree | | | 40-40-0(5) | 40-40-0(5) | 40-40-0(5) | 40-37-3(25) |
| | Ultimate vacuum degree Pa (after 1 hr) | | Pa | less than 0.4 | less than 0.4 | less than 0.4 | 0.6 |
| Shear Stability Test | 40° C. Kinematic viscosity | 40° C. Kinematic viscosity of sample oil after test | $mm^2/s$ | 68.02 | 73.69 | 62.14 | 66.58 |
| | | Shear stability | % | 0.3 | 0.3 | 0.2 | −0.1 |
| | 100° C. Kinematic viscosity | 100° C. Kinematic viscosity of sample oil after test | $mm^2/s$ | 10.07 | 10.61 | 9.532 | 8.775 |
| | | Shear stability | % | 0.1 | 0.1 | 0 | 0.1 |
| | Viscosity index of sample oil after test | | — | 132 | 132 | 132 | 104 |
| Indiana Oxidation Test | 40° C. Kinematic viscosity of sample oil after test | | $mm^2/s$ | 68.58 | 74.02 | 62.86 | 66.87 |
| | Acid number increase | | mgKOH/g | 0.02 | 0.03 | 0.02 | 0.03 |
| | RPVOT value of sample oil after test | | min | 122 | 141 | 136 | 104 |
| | Millipore amount | | mg/100 ml | 1.7 | 2.2 | 1.9 | 2.2 |

| | | | | Comparative Example | | | |
|---|---|---|---|---|---|---|---|
| | | | | I-2 | I-3 | I-4 | I-5 |
| Composition of Vacuum Pump Oil | Base Oil | Mineral oil (1-1) | mass % | — | 25.00 | — | — |
| | | Mineral oil (1-2) | mass % | 81.69 | — | — | — |
| | | Mineral oil (1-3) | mass % | 18.00 | 75.00 | 93.69 | 94.00 |
| | Additives | Phenol-based compound | mass % | 0.20 | — | 0.20 | — |
| | | Amine-based compound | mass % | 0.10 | — | 0.10 | — |
| | | Metal deactivator | mass % | 0.01 | — | 0.01 | — |
| | | Polymer component | mass % | — | — | 6.00 | 6.00 |
| | Total | | mass % | 100.00 | 100.00 | 100.00 | 100.00 |
| Properties of Base Oil | Temperature gradient Δ\|η*\| of complex viscosity between two points of −10° C. and −20° C. | | Pa · s/° C. | 8.904 | 0.289 | 0.144 | 0.144 |

TABLE 1-continued

| | | | | | | | |
|---|---|---|---|---|---|---|---|
| Properties of Vacuum Pump Oil | 40° C. Kinematic viscosity | | $mm^2/s$ | 67.5 | 68.66 | 70.82 | 70.08 |
| | 100° C. Kinematic viscosity | | $mm^2/s$ | 8.939 | 10.13 | 11.90 | 11.75 |
| | Viscosity index | | — | 106 | 132 | 165 | 164 |
| | Sulfur atom content | | mass ppm | 1880 | less than 10 | less than 10 | less than 10 |
| Characteristics of Vacuum Pump Oil | RPVOT value | | min | 266 | 33 | 256 | 30 |
| | Anti-emulsification degree | | | 40-37-3(15) | 41-39-0(5) | 40-37-3(10) | 40-37-3(5) |
| | Ultimate vacuum degree Pa (after 1 hr) | | Pa | 0.6 | less than 0.4 | less than 0.4 | less than 0.4 |
| Shear Stability Test | 40° C. Kinematic viscosity | 40° C. Kinematic viscosity of sample oil after test | $mm^2/s$ | 67.43 | 68.43 | 45.99 | 45.88 |
| | | Shear stability | % | 0.1 | 0.3 | 35.8 | 36.3 |
| | 100° C. Kinematic viscosity | 100° C. Kinematic viscosity of sample oil after test | $mm^2/s$ | 8.93 | 10.12 | 7.929 | 7.933 |
| | | Shear stability | % | 0.1 | 0.1 | 34.7 | 34.1 |
| | Viscosity index of sample oil after test | | — | 106 | 132 | 144 | 145 |
| Indiana Oxidation Test | 40° C. Kinematic viscosity of sample oil after test | | $mm^2/s$ | 67.98 | 74.05 | 71.14 | 49.91 |
| | Acid number increase | | mgKOH/g | 0.03 | 0.89 | 0.03 | 1.77 |
| | RPVOT value of sample oil after test | | min | 134 | 17 | 239 | 18 |
| | Millipore amount | | mg/100 ml | 1.4 | 0.5 | 3.5 | 0.4 |

The vacuum pump oils prepared in Examples I-1 to I-3 are conformable to VG68 Standard, and resulted in that while keeping a high ultimate vacuum degree, they are excellent in water separability, oxidation stability and shear stability.

On the other hand, the vacuum pump oils of Comparative Examples I-1 and I-2 use a mineral oil having a high temperature gradient of complex viscosity between two points of −10° C. and −20° C. and therefore, as compared with the vacuum pump oils of Examples, they resulted in that the ultimate vacuum degree thereof is low and the water separability thereof is poor.

The vacuum pump oils of Comparative Examples I-3 and I-5 do not contain both a phenol compound and an amine compound, and therefore as compared with the vacuum pump oils of Examples, they resulted in that the RPVOT value thereof is low, the acid number increase after the Indiana oxidation test is large and the oxidation stability is poor.

Further, the vacuum pump oils of Comparative Examples I-4 and I-5 contain a certain amount of a polymer component added thereto so as to make them conformable to VG68 Standard, but resulted in that their shear stability is poor and their water separability is also poor. In addition, the vacuum pump oil of Comparative Example I-4 has an increased millipore value after the Indiana oxidation test, and is therefore considered to have a risk of sludge generation in long-term use.

Examples II-1 to II-2, Comparative Examples II-1 to II-5

Various additives shown in Table 2 were blended with the base oil shown in Table 2 at the blending ratio also shown therein to prepare vacuum pump oils.

The details of the base oils and the additives used herein are as follows.

Mineral Oil (2-1):

This is a paraffin-based mineral oil classified into Group 2 in the API category, which is obtained by hydrogenation isomerization dewaxing treatment of a raw material oil of a distillate of 1860 neutral or more containing a slack wax and a bottom oil obtained through hydrocracking of a heavy fuel oil, followed by hydrogenation finishing treatment. The hydrogenation isomerization dewax treatment was carried out after the bottom fraction of a reduced-pressure fraction was subjected to hydrogenation desulfurization. 40° C. kinematic viscosity=408.8 $mm^2/s$, viscosity index=107, % $C_A$=0, % $C_P$=70.0, % $C_N$=30.0.

The conditions for the hydrogenation isomerization dewaxing treatment are as follows.

Hydrogen gas supply ratio: 250 $Nm^3$ or more and less than 300 $Nm^3$ relative to 1 kiloliter of the supplied starting material oil Hydrogen partial pressure: 3 MPa or more and less than 10 MPa Liquid hourly space velocity (LHSV): 0.5 to 1.0 $hr^{-1}$ Reaction temperature: 300 to 350° C.

Mineral Oil (2-2):

This is a paraffin-base mineral oil classified into Group 2 in the API category, which is obtained by hydrogenation isomerization dewaxing treatment of a raw material oil of a distillate of 340 neutral or more containing a slack wax and a bottom oil obtained through hydrocracking of a heavy fuel oil, followed by hydrogenation finishing treatment. 40° C. kinematic viscosity=75.2 $mm^2/s$, viscosity index=98, % $C_A$=5.3, % $C_P$=66.8, % $C_N$=27.9.

The conditions for the hydrogenation isomerization dewaxing treatment are as follows.

Hydrogen gas supply ratio: 250 $Nm^3$ or more and less than 300 $Nm^3$ relative to 1 kiloliter of the supplied starting material oil Hydrogen partial pressure: 3 MPa or more and less than 10 MPa Liquid hourly space velocity (LHSV): 0.5 $hr^{-1}$ to 1.0 $hr^{-1}$ Reaction temperature: 300° C. to 350° C.

Mineral Oil (2-3):

This is a paraffin-based mineral oil classified into Group 2 in the API category, which is obtained by hydrogenation isomerization dewaxing treatment of a raw material oil of a distillate of 160 neutral or more containing a slack wax and a bottom oil obtained through hydrocracking of a heavy fuel oil, followed by hydrogenation finishing treatment. 40° C. kinematic viscosity=34.96 $mm^2/s$, viscosity index=119, % $C_A$=0, % $C_P$=74.5%, % $C_N$=25.5.

The conditions for the hydrogenation isomerization dewaxing treatment are as follows.

Hydrogen gas supply ratio: 250 $Nm^3$ or more and less than 300 $Nm^3$ relative to 1 kiloliter of the supplied starting material oil Hydrogen partial pressure: 3 MPa or more and less than 10 MPa Liquid hourly space velocity (LHSV): 0.5 $hr^{-1}$ to 1.0 $hr^{-1}$ Reaction temperature: 300° C. to 350° C.

Mineral oil (2-4):

This is a mineral oil classified into Group 3 in the API category, which is obtained by hydrogenation isomerization dewaxing treatment of a raw material oil of a distillate of 200 neutral or more containing a slack wax and a bottom oil obtained through hydrocracking of a heavy fuel oil, followed by hydrogenation finishing treatment. 40° C. kinematic viscosity=43.75 $mm^2/s$, viscosity index=143, % $C_A$=0, % $C_P$=94.7, % $C_N$=6.3.

The conditions for the hydrogenation isomerization dewaxing treatment are as follows.

Hydrogen gas supply ratio: 300 $Nm^3$ to 400 $Nm^3$ relative to 1 kiloliter of the supplied starting material oil Hydrogen partial pressure: 10 MPa to 15 MPa Liquid hourly space velocity (LHSV): 0.5 $hr^{-1}$ to 1.0 $hr^{-1}$ Reaction temperature: 300° C. to 350° C.

Mineral Oil (2-5):

This is a mineral oil classified into Group 3 in the API category, which is obtained by hydrogenation isomerization dewaxing treatment of a raw material oil of a distillate of 85 neutral or more containing a slack wax and a bottom oil obtained through hydrocracking of a heavy fuel oil, followed by hydrogenation finishing treatment. 40° C. kinematic viscosity=18.71 $mm^2/s$, viscosity index=126, % $C_A$=0, % $C_P$=93.4, % $C_N$=6.8.

The conditions for the hydrogenation isomerization dewaxing treatment are as follows.

Hydrogen gas supply ratio: 300 $Nm^3$ to 400 $Nm^3$ relative to 1 kiloliter of the supplied starting material oil Hydrogen partial pressure: 10 MPa to 15 MPa Liquid hourly space velocity (LHSV): 0.5 $hr^{-1}$ to 1.0 $hr^{-1}$ Reaction temperature: 300° C. to 350° C.

<Various Additives>

Phenol-based compound: benzenepropanoic acid 3,5-bis(1,1-dimethylethyl)-4-hydroxyalkyl ester Amine-based compound: 4,4'-dioctyldiphenylamine Metal deactivator: 2-(2-hydroxy-4-methylphenyl)benzotriazole Polymer component: viscosity index improver having a resin content of 4.9% by mass, prepared by diluting polyisobutene having Mn of 320,000 with 150 N mineral oil

TABLE 2

| | | | | Example | | Comparative Example | |
|---|---|---|---|---|---|---|---|
| | | | | II-1 | II-2 | II-1 | II-2 |
| Composition of Vacuum Pump Oil | Base Oil | Mineral oil (2-1) | mass % | 3.00 | 38.69 | 3.00 | 39.00 |
| | | Mineral oil (2-2) | mass % | — | — | — | — |
| | | Mineral oil (2-3) | mass % | — | — | — | — |
| | | Mineral oil (2-4) | mass % | 96.69 | — | 97.00 | — |
| | | Mineral oil (2-5) | mass % | — | 61.00 | — | 61.00 |
| | Additives | Phenol-based compound | mass % | 0.20 | 0.20 | — | — |
| | | Amine-based compound | mass % | 0.10 | 0.10 | — | — |
| | | Metal deactivator | mass % | 0.01 | 0.01 | — | — |
| | | Polymer component | mass % | — | — | — | — |
| | Total | | mass % | 100.00 | 100.00 | 100.00 | 100.00 |
| Properties of Base Oil | Temperature gradient $\Delta\lvert\eta^*\rvert$ of complex viscosity between two points of −15° C. and −25° C. | | Pa · s/° C. | 0.279 | 1.072 | 0.266 | 1.031 |
| Properties of Vacuum Pump Oil | 40° C. Kinematic viscosity | | $mm^2/s$ | 46.02 | 49.08 | 45.88 | 48.88 |
| | 100° C. Kinematic viscosity | | $mm^2/s$ | 7.873 | 7.945 | 7.9 | 7.95 |
| | Viscosity index | | — | 142 | 132 | 143 | 133 |
| | Sulfur atom content | | mass ppm | less than 10 | less than 10 | less than 10 | less than 10 |
| Characteristics of Vacuum Pump Oil | RPVOT value | | min | 266 | 249 | 30 | 24 |
| | Anti-emulsification degree | | | 41-39-0(5) | 41-39-0(5) | 40-40-0(5) | 40-40-0(5) |
| | Ultimate vacuum degree Pa (after 1 hr) | | Pa | less than 0.4 | less than 0.4 | less than 0.4 | less than 0.4 |
| Shear Stability Test | 40° C. Kinematic viscosity | 40° C. Kinematic viscosity of sample oil after test | $mm^2/s$ | 45.88 | 46.21 | 45.74 | 48.733 |
| | | Shear stability | % | 0.3 | 0.3 | 0.3 | 0.3 |
| | 100° C. Kinematic viscosity | 100° C. Kinematic viscosity of sample oil after test | $mm^2/s$ | 7.865 | 7.559 | 7.892 | 7.942 |
| | | Shear stability | % | 0.1 | 0.1 | 0.1 | 0.1 |
| | Viscosity index of sample oil after test | | — | 142 | 129 | 144 | 132 |
| Indiana Oxidation Test | 40° C. Kinematic viscosity of sample oil after test | | $mm^2/s$ | 46.42 | 46.88 | 49.48 | 52.602 |
| | Acid number increase | | mgKOH/g | 0.02 | 0.02 | 0.98 | 0.83 |
| | RPVOT value of sample oil after test | | min | 132 | 154 | 14 | 19 |
| | Millipore amount | | mg/100 ml | 2.3 | 2.3 | 2.7 | 2.2 |

TABLE 2-continued

| | | | | Comparative Example | | |
|---|---|---|---|---|---|---|
| | | | | II-3 | II-4 | II-5 |
| Composition of Vacuum Pump Oil | Base Oil | Mineral oil (2-1) | mass % | — | — | — |
| | | Mineral oil (2-2) | mass % | 41.00 | 70.00 | — |
| | | Mineral oil (2-3) | mass % | 58.69 | — | — |
| | | Mineral oil (2-4) | mass % | — | — | — |
| | | Mineral oil (2-5) | mass % | — | 29.69 | 88.89 |
| | Additives | Phenol-based compound | mass % | 0.20 | 0.20 | 0.20 |
| | | Amine-based compound | mass % | 0.10 | 0.10 | 0.10 |
| | | Metal deactivator | mass % | 0.01 | 0.01 | 0.01 |
| | | Polymer component | mass % | — | — | 10.80 |
| | Total | | mass % | 100.00 | 100.00 | 100.00 |
| Properties of Base Oil | Temperature gradient Δ\|η*\| of complex viscosity between two points of −15° C. and −25° C. | | Pa · s/° C. | 136.9 | 15.284 | 0.213 |
| Properties of Vacuum Pump Oil | 40° C. Kinematic viscosity | | $mm^2/s$ | 46.48 | 46.17 | 46.61 |
| | 100° C. Kinematic viscosity | | $mm^2/s$ | 7.119 | 7.053 | 10.50 |
| | Viscosity index | | — | 112 | 111 | 223 |
| | Sulfur atom content | | mass ppm | 2000 | 2000 | less than 10 |
| Characteristics of Vacuum Pump Oil | RPVOT value | | min | 232 | 244 | 254 |
| | Anti-emulsification degree | | | 40-37-3(20) | 40-37-3(15) | 40-38-2(15) |
| | Ultimate vacuum degree Pa (after 1 hr) | | Pa | 0.7 | 0.6 | less than 0.4 |
| Shear Stability Test | 40° C. Kinematic viscosity | 40° C. Kinematic viscosity of sample oil after test | $mm^2/s$ | 46.48 | 46.03 | 32.31 |
| | | Shear stability | % | 0 | 0.3 | 36.6 |
| | 100° C. Kinematic viscosity | 100° C. Kinematic viscosity of sample oil after test | $mm^2/s$ | 7.112 | 7.046 | 6.741 |
| | | Shear stability | % | 0.1 | 0.1 | 35.8 |
| | Viscosity index of sample oil after test | | — | 112 | 111 | 125 |
| Indiana Oxidation Test | 40° C. Kinematic viscosity of sample oil after test | | $mm^2/s$ | 46.79 | 46.31 | 48.22 |
| | Acid number increase | | mgKOH/g | 0.01 | 0.03 | 0.03 |
| | RPVOT value of sample oil after test | | min | 121 | 122 | 118 |
| | Millipore amount | | mg/100 ml | 3.3 | 3.5 | 3.1 |

The vacuum pump oils prepared in Examples II-1 and II-2 are conformable to VG46 Standard, and resulted in that while keeping a high ultimate vacuum degree, they are excellent in water separability, oxidation stability and shear stability.

On the other hand, the vacuum pump oils of Comparative Examples II-1 and II-2 do not contain both a phenol-based compound and an amine-based compound and therefore, as compared with the vacuum pump oils of Examples, they resulted in that the RPVOT value is low, the acid number increase after the Indiana oxidation test is large to mean degradation, and the oxidation stability is poor.

The vacuum pump oils of Comparative Examples II-3 and II-4 use mineral oil(s) having a high temperature gradient of complex viscosity between two points of −15° C. and −25° C., and therefore, as compared with the vacuum pump oils of Examples, they resulted in that the ultimate vacuum degree is low, reduction in the anti-emulsification degree owing to blending with additives of phenol-based compound and others could not be prevented and the water separability is poor.

Further, the vacuum pump oil of Comparative Examples II-5 contains a certain amount of a polymer component added thereto so as to make it conformable to VG46 Standard, but resulted in that the shear stability thereof is poor and the water separability thereof is also poor.

The invention claimed is:

1. A vacuum pump oil, comprising:

a mineral oil (A) having a temperature gradient Δ|η*| of complex viscosity between two points of t(° C.) and t−10(° C.) (where $-15 \leq t \leq -10$), as measured using a rotary rheometer at an angular velocity of 6.3 rad/s, of 10 Pa·s/° C. or less; and a phenol-based compound (B) and an amine-based compound (C), wherein the phenol-based compound (B) is a hindered, monocyclic phenol-based compound comprising an ester group, and the amine-based compound (C) is a diphenylamine compound, wherein the vacuum pump oil has a viscosity index of less than 160, the vacuum pump oil has an anti-emulsification degree of less than 20 minutes, as measured according to JIS K2520, the mineral oil (A) comprises a mineral oil (A1) classified into Group 3 of the API category and a mineral oil (A2) classified into Group 2 in the API category, wherein a content ratio of the mineral oil (A1) to the mineral oil (A2) [(A1)/(A2)] is, as a ratio by mass, 50/50 to 99/1, a content of the phenol-based compound (B) is in a range of from 0.02 to 2% by mass, based on a total amount of the vacuum pump oil, and a content of the amine-based compound (C) is in a range of from 0.02 to 2% by mass, based on the total amount of the vacuum pump oil.

2. The vacuum pump oil according to claim 1, wherein the mineral oil (A) has a temperature gradient $\Delta|\eta^*|$ of complex viscosity between two points of −10° C. and −20° C., as measured using a rotary rheometer at an angular velocity of 6.3 rad/s, of 5 Pa·s/° C. or less; and the viscosity index of the vacuum pump oil is less than 150.

3. The vacuum pump oil according to claim 2, which conforms to VG68 Standard of the viscosity grade defined in ISO 3448.

4. The vacuum pump oil according to claim 1, wherein the mineral oil (A) has a temperature gradient $\Delta|\eta^*|$ of complex viscosity between two points of −15° C. and −25° C., as measured using a rotary rheometer at an angular velocity of 6.3 rad/s, of 10 Pa·s/° C. or less.

5. The vacuum pump oil according to claim 4, which conforms to VG46 Standard of the viscosity grade defined in ISO 3448.

6. The vacuum pump oil according to claim 1, wherein a content of a polymer component having a number average molecular weight of 2,000 or more is less than 3% by mass based on the total amount of the vacuum pump oil.

7. The vacuum pump oil according to claim 1, wherein the mineral oil (A2) is a paraffin-based mineral oil.

8. The vacuum pump oil according to claim 2, wherein a content ratio of the mineral oil (A1) to the mineral oil (A2) [(A1)/(A2)] is, as a ratio by mass, 50/50 to 95/5.

9. The vacuum pump oil according to claim 1, which has an anti-emulsification degree of less than 15 minutes, as measured according to JIS K2520.

10. The vacuum pump oil according to claim 1, which has an anti-emulsification degree of less than 10 minutes, as measured according to JIS K2520.

11. The vacuum pump oil according to claim 1, which has an anti-emulsification degree of less than 5 minutes, as measured according to JIS K2520.

12. A vacuum pump, comprising the vacuum pump oil according to claim 1.

13. A method of vacuum pumping, the method comprising vacuum pumping with the vacuum pump according to claim 12.

14. A method of producing a semiconductor, a solar cell, an airplane, an automobile, or a food, the method comprising vacuum pumping with the vacuum pump according to claim 12.

15. The vacuum pump oil according to claim 1, wherein the mineral oil (A) has a temperature gradient $\Delta|\eta^*|$ of complex viscosity between two points of t(° C.) and t−10(° C.) (where $-15 \leq t \leq -10$), as measured using a rotary rheometer at an angular velocity of 6.3 rad/s, of 8.0 Pa·s/° C. or less.

* * * * *